US006681027B1

(12) United States Patent
Lu

(10) Patent No.: US 6,681,027 B1
(45) Date of Patent: Jan. 20, 2004

(54) MAGNETIC CORE FOR SPEAKER

(75) Inventor: Yi-Hung Lu, Taoyuan (TW)

(73) Assignee: Zylux Acoustic Corp., Taipei (TW)

( * ) Notice: Subject to any disclaimer, the term of this patent is extended or adjusted under 35 U.S.C. 154(b) by 0 days.

(21) Appl. No.: 10/219,130

(22) Filed: Aug. 16, 2002

(30) Foreign Application Priority Data

Jul. 12, 2002 (TW) ..... 91210656 U

(51) Int. Cl.[7] ..... H04R 25/00

(52) U.S. Cl. ..... 381/412; 381/414; 381/420; 381/421

(58) Field of Search ..... 381/396, 400, 381/401, 412, 414, 420, 421, 422, 182, 186; 335/222

(56) References Cited

U.S. PATENT DOCUMENTS 5,604,815 A * 2/1997 Paddock ..... 381/400

* cited by examiner

*Primary Examiner*—Huyen Le
(74) *Attorney, Agent, or Firm*—Troxell Law Office PLLC

(57) ABSTRACT

A magnetic core for speaker is constructed to include an annular magnet connectable to the body of the speaker, a center magnet mounted in the center of the annular magnet and connectable to the body of the speaker, an annular magnetically conducting plate mounted on the topmost edge of the annular magnet, and a center magnetically conducting plate mounted on the topmost edge of the center magnet for producing a magnetic loop with the annular magnetically conducting plate.

2 Claims, 4 Drawing Sheets

MAGNETIC CORE FOR SPEAKER

BACKGROUND OF THE INVENTION

1. Field of the invention:

The present invention relates to a magnetic core for speaker and, more particularly, to a compact magnetic core, which greatly reduces the weight of the speaker.

2. Description of the Related Art:

A variety of speakers have been disclosed for use in home stereo systems, audio/video systems, car stereo systems, etc., for voice output. A speaker has a magnetic core for producing lines of magnetic force or a magnetic loop. FIGS. 1 and 2 show a magnetic core for speaker according to the prior art. According to this design, the magnetic core comprises a magnetically conducting holder base B, a magnetically conducting center rod D vertically mounted on the top center of the holder base B, an annular magnet A mounted on the holder base B around the magnetically conducting center rod D, and a magnetically conducting annular plate C covered on the top side of the annular magnet A around the magnetically conducting center rod D. If the polarity of the magnetically conducting annular plate C is N pole, the polarity of the magnetically conducting center rod D becomes S pole, thereby causing a magnetic loop E to be produced.

FIG. 3 shows another structure of magnetic core for speaker according to the prior art. According to this design, the magnetic core comprises a hollow magnetically conducting hollow holder base G, a magnet F mounted in the hollow magnetically conducting hollow holder base G, and a magnetically conducting plate H covered on the topmost edge of the magnet F. When the annular top of the magnetically conducting hollow holder base G produced N pole, the magnetically conducting plate H produces S pole, resulting in a magnetic loop J around the magnetically conducting plate H within the magnetic holder base G.

The aforesaid two prior art designs have the common drawback of heavy weight. Because of the use of the magnetically conducting holder base B or G, the heavy weight of the magnetic core is unfavorable to portable speakers.

SUMMARY OF THE INVENTION

The present invention has been accomplished under the circumstances in view. It is therefore the main object of the present invention to provide a magnetic core for speaker, which is compact and lightweight. To achieve this and other objects of the present invention, the magnetic core comprises an annular magnet connectable to the body of the speaker, a center magnet mounted in the center of the annular magnet and connectable to the body of the speaker, an annular magnetically conducting plate mounted on the topmost edge of the annular magnet, and a center magnetically conducting plate mounted on the topmost edge of the center magnet for producing a magnetic loop with the annular magnetically conducting plate. Further, the annular magnet, the center magnet, the annular magnetically conducting plate and the center magnetically conducting plate commonly have a circular outer diameter. When installed, the annular magnet, the center magnet, the annular magnetically conducting plate and the center magnetically conducting plate are concentric.

BRIEF DESCRIPTION OF THE DRAWINGS

The present invention can be more fully understood by reference to the following detailed description and accompanying drawings, in which.

DETAILED DESCRIPTION OF THE PREFERRED EMBODIMENT

Figure 1:
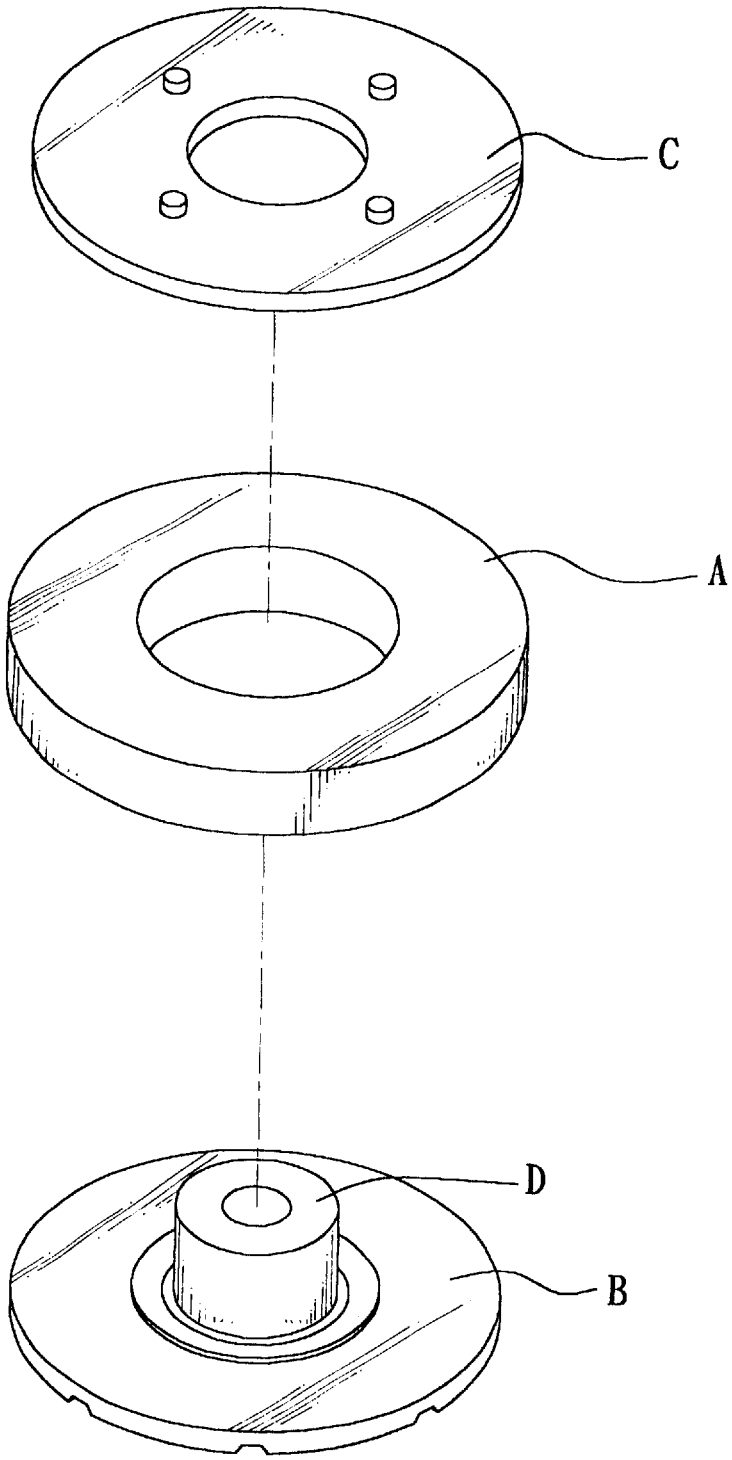
(PRIOR ART) FIG. 1
FIG. 1 is an exploded view of a magnetic core for speaker according to the prior art.
Figure 2:
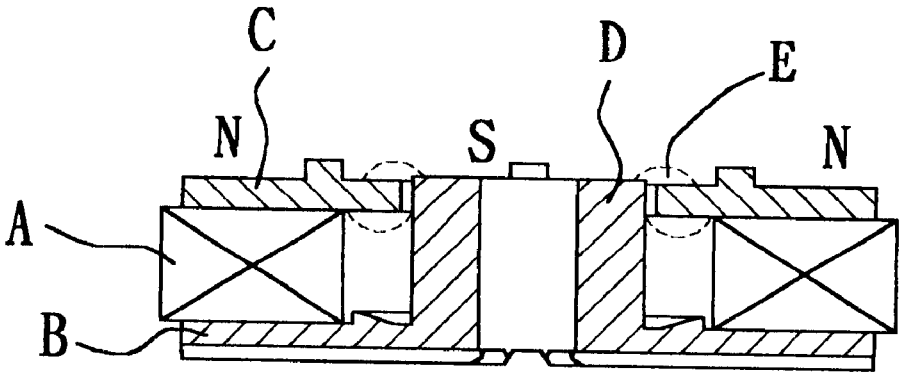
(PRIOR ART) FIG. 2
FIG. 2 is a sectional assembly view of the magnetic core for speaker according to the prior art.
Figure 3:
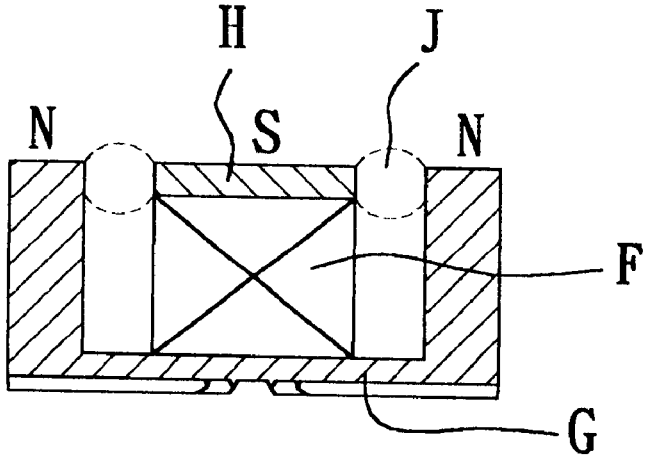
(PRIOR ART) FIG. 3
FIG. 3 is a sectional view of another structure of magnetic core for speaker according to the prior art.
Figure 4:
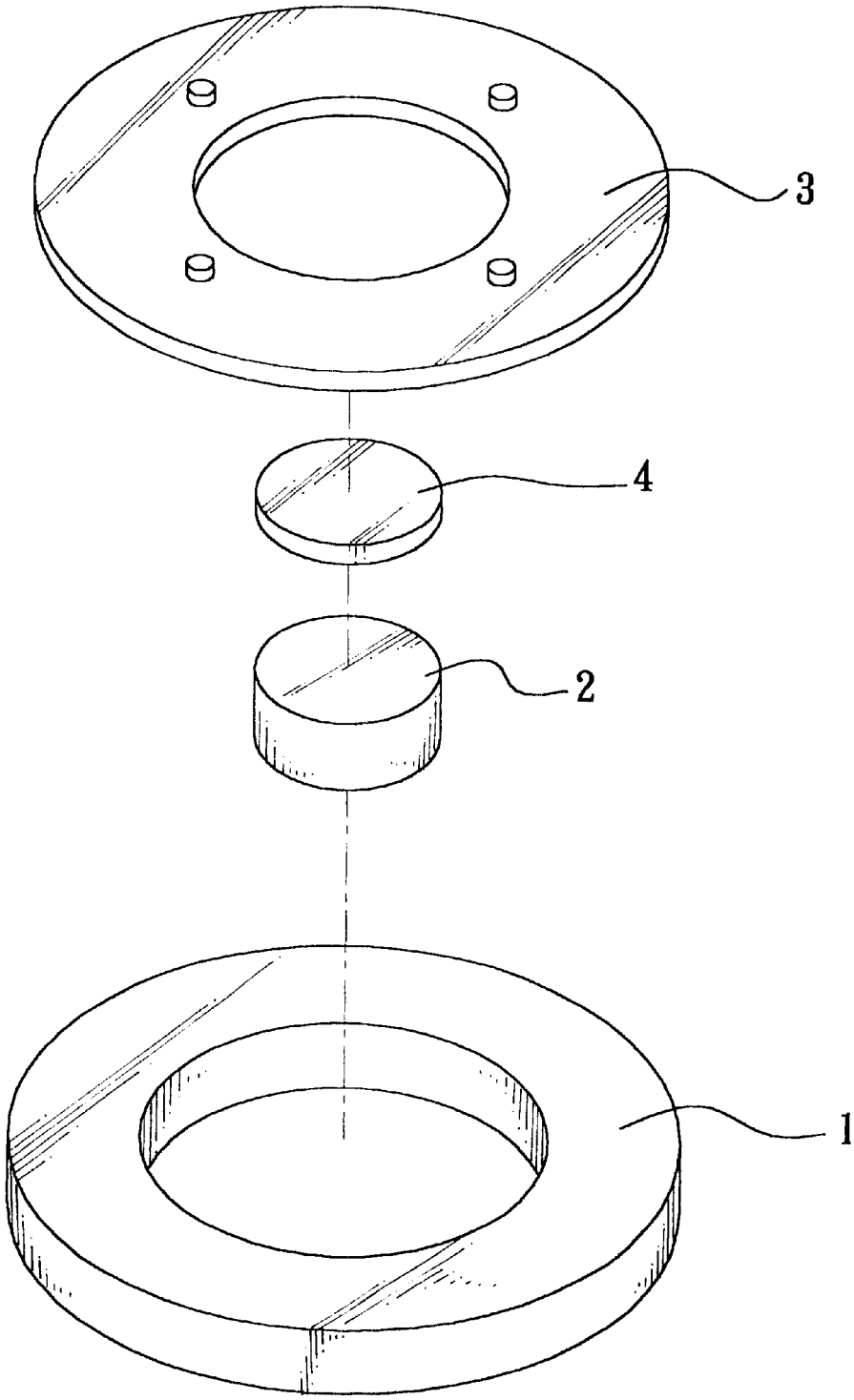
FIG. 4 is an exploded view of a magnetic core for speaker according to the present invention.
Figure 5:
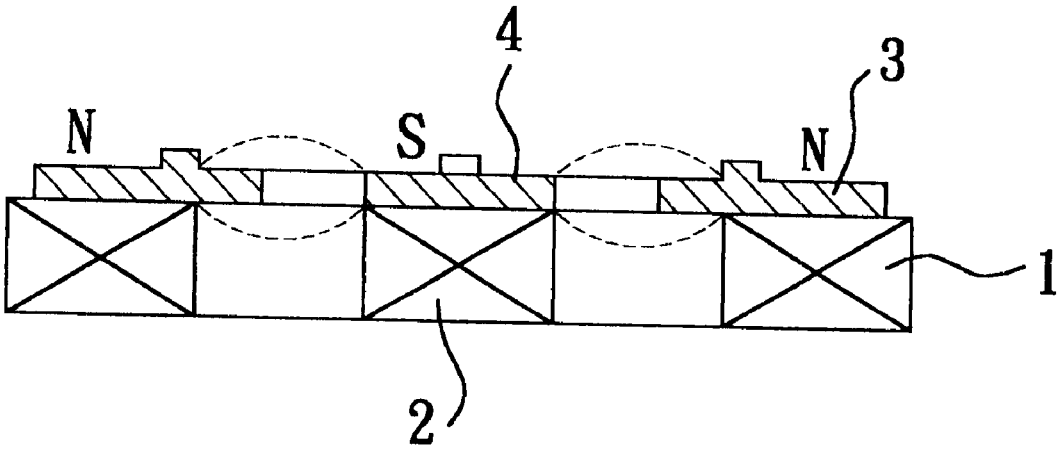
FIG. 5 is a sectional assembly view of the magnetic core for speaker according to the present invention.

Referring to FIGS. 4 and 5, a magnetic core for speaker in accordance with the present invention is shown comprising an annular magnet 1, a center magnet 2, an annular magnetically conducting plate 3, and a center magnetically conducting plate 4.

The annular magnet 1 is connected to the cone frame of the speaker. The topside of the annular magnet 1 produces a magnetic force. According to this embodiment, the topside of the annular magnet 1 is N pole. The center magnet 2 is a cylindrical magnet put in the center of the annular magnet 1. In order to produce lines of magnetic force, the polarity of the center magnet 2 is reversed to the annular magnet 1, i.e., the topside of the center magnet 2 is S pole. The annular magnetically conducting plate 3 is mounted on the topside of the annular magnet 1. The outer diameter as well as inner diameter of the annular magnetically conducting plate 3 is respectively smaller than the annular magnet 1. When installed in the cone frame of the speaker, the annular magnetically conducting plate 3 is relatively closer to the center magnet 2 than the annular magnet 1, so that the magnetic force of the annular magnet 1 can be guided out through the annular magnetically conducting plate 3. The center magnetically conducting plate 4 fits the center magnet 2 in size, and is mounted on the topside of the center magnet 2. According to this embodiment, the annular magnet 1, the center magnet 2, the annular magnetically conducting plate 3 and the center magnetically conducting plate 4 commonly have a circular outer diameter. When installed, the annular magnet 1, the center magnet 2, the annular magnetically conducting plate 3 and the center magnetically conducting plate 4 are concentric.

Because the present invention uses the center magnet 2 instead of the heavy holder base as used in the prior art designs, the total weight of the speaker is greatly reduced (about 30% less in comparison with prior art designs of similar output).

A prototype of magnetic core for speaker has been constructed with the features of FIGS. 4 and 5. The magnetic core for speaker functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A magnetic core for a speaker comprising:

a) an annular magnet;

b) a center magnet concentrically positioned in a center of the annular magnet;

c) an annular magnetically conducting plate connected to a top of the annular magnet; and d) a center magnetically conducting plate connected to a top of the center magnet, the center magnetically conducting plate and center magnet having equal outer diameters, wherein an outer diameter and an inner diameter of the annular magnetically conducting plate are respectively smaller than an outer diameter and an inner diameter of the annular magnet so that the annular magnetically conducting plate is closer to the center magnet than the annular magnet so as to produce a magnetic loop with the center magnetically conducting plate.

2. The magnetic core for the speaker according to claim 1, wherein the annular magnet, the center magnet, the annular magnetically conducting plate and the center magnetically conducting plate have circular outer diameters and a common center.

* * * * *